US006255917B1

(12) United States Patent
Scott

(10) Patent No.: US 6,255,917 B1
(45) Date of Patent: Jul. 3, 2001

(54) FILTER WITH STEPPED IMPEDANCE RESONATORS AND METHOD OF MAKING THE FILTER

(75) Inventor: Richard D. Scott, Socorro, NM (US)

(73) Assignee: Teledyne Technologies Incorporated, Los Angeles, CA (US)

( * ) Notice: Subject to any disclaimer, the term of this patent is extended or adjusted under 35 U.S.C. 154(b) by 0 days.

(21) Appl. No.: 09/228,378

(22) Filed: Jan. 12, 1999

(51) Int. Cl.[7] ..... H01P 1/20; H01P 1/205; H01P 7/04; H01P 11/00

(52) U.S. Cl. ..... 333/202; 333/206; 333/219; 333/222; 333/230; 29/527.2; 29/600

(58) Field of Search ..... 333/202, 203, 333/206, 207, 208, 209, 212, 219, 219.1, 222, 223, 227, 230, 231, 235; 29/527.2, 592.1, 600

(56) References Cited

U.S. PATENT DOCUMENTS

| | | | | |
|---|---|---|---|---|
| 3,955,161 | | 5/1976 | MacTurk | 333/209 |
| 4,034,319 | | 7/1977 | Olsson | 333/203 |
| 4,037,182 | | 7/1977 | Burnett et al. | 333/203 |
| 4,053,855 | * | 10/1977 | Kivi et al. | 333/203 |
| 4,059,815 | * | 11/1977 | Makimoto et al. | 333/234 |
| 4,184,123 | * | 1/1980 | Grill et al. | 333/230 X |
| 4,216,448 | | 8/1980 | Kasuga et al. | 333/203 |
| 4,278,957 | | 7/1981 | Starai et al. | 333/202 |
| 4,292,610 | * | 9/1981 | Makimoto et al. | 333/222 |
| 4,506,241 | | 3/1985 | Makimoto et al. | 333/222 |
| 4,560,829 | * | 12/1985 | Reed et al. | 174/102 R |
| 4,631,506 | | 12/1986 | Makimoto et al. | 333/224 |
| 4,733,208 | | 3/1988 | Ishikawa et al. | 333/202 |
| 4,891,615 | * | 1/1990 | Komazaki et al. | 333/222 X |
| 4,985,690 | | 1/1991 | Eguchi et al. | 333/222 |
| 5,045,971 | | 9/1991 | Ono et al. | 361/386 |
| 5,144,268 | | 9/1992 | Weidman | 333/204 |
| 5,329,687 | | 7/1994 | Scott et al. | 29/527.2 |
| 5,389,903 | * | 2/1995 | Piirainen | 333/206 X |
| 5,495,215 | * | 2/1996 | Newell et al. | 333/223 X |
| 5,696,473 | | 12/1997 | Tsujiguchi et al. | 333/202 |
| 5,719,539 | | 2/1998 | Ishizaki et al. | 333/204 |
| 5,742,002 | * | 4/1998 | Arredondo et al. | 174/29 |
| 5,742,214 | | 4/1998 | Toda et al. | 333/202 |
| 5,748,058 | | 5/1998 | Scott | 333/202 |
| 5,990,763 | * | 11/1999 | Sipilä | 333/203 X |

FOREIGN PATENT DOCUMENTS

| | | | |
|---|---|---|---|
| 0641035 A2 | | 3/1995 | (EP) . |
| 2143237A | * | 2/1985 | (GB) . |
| 56-107601 | * | 8/1981 | (JP) . |
| WO 93/01625 | * | 1/1993 | (WO) . |

OTHER PUBLICATIONS

Sagawa et al., Geometrical Structures and Fundamental Characteristics of Microwave Stepped Impedance Resonators, IEEE Transactions on Microwave Theory and Techniques, v.45, No.7, Jul. 1997, pp. 1078–1085.

Makimoto et al., Compact Bandpass Filters Using Stepped Impedance Resonators, Proceedings of the IEEE, v.67, No.1, Jan. 1979, pp. 16–19.

* cited by examiner

*Primary Examiner*—Robert Pascal
*Assistant Examiner*—Barbara Summons
(74) *Attorney, Agent, or Firm*—Kirkpatrick & Lockhart LLP

(57) ABSTRACT

A filter including first and second resonators and a coaxial cable connecting the resonators. Also, a filter including a housing and stepped impedance resonators wherein the high impedance portions of the stepped resonators are integral with the housing. Also, methods of manufacturing the filters.

53 Claims, 7 Drawing Sheets

FILTER WITH STEPPED IMPEDANCE RESONATORS AND METHOD OF MAKING THE FILTER

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to a filter and, more particularly, to filters including capacitively coupled resonators and filters including resonators integral with a housing. The present invention is also directed to methods of making a filter.

2. Description of the Background

Filters utilizing stepped impedance resonators (SIRs) have been realized in various media, such as printed microstrip circuits, stripline, dielectric block, and air dielectric. Microstrip and stripline filters, however, often require the use of expensive substrate material and labor intensive assembly. Moreover, the electrical performance of such filters diminishes at lower frequencies, such as below about 400 MHz. Dielectric block resonators typically require the use of expensive dielectric material, which are additionally too heavy for certain applications. Furthermore, dielectric block resonators exhibit insertion loss, which is the loss of signal energy as the signal passes through the filter, which varies significantly based upon the type of dielectric used. Air dielectric combline filters use distributed capacitive coupling, which limits the bandwidth of the filter.

Accordingly, there exists a need for a filter that is small and light weight, and which maintains satisfactory electrical performance characteristics. Also, a need exists for such a filter which is operable at lower frequency ranges. In addition, there exists a need for a such a filter which allows for a wider range of bandwidths.

Brief Summary of the Invention

The present invention is directed to a filter including first and second resonators connected by a coaxial cable. The coaxial cable includes an inner conductor connected to the first resonator and an outer conductor connected to the second resonator.

The present invention is also directed to a filter including a housing and a plurality of stepped impedance resonators in which the high impedance portions of the stepped impedance resonators are integral with the housing. The stepped impedance resonators may be capacitively coupled, for example, by a coaxial cable or a trimmer capacitor. The present invention is also directed to a filter including a housing and a plurality of stepped impedance resonators in which the resonators are coupled by trimmer capacitors.

The present invention is also directed to a method of manufacturing a filter including forming a housing and a high impedance portion of a stepped impedance resonator as an integral piece, and fastening a low impedance portion of the resonator to the high impedance portion. The present invention is also directed to methods of coupling resonators.

The present invention solves problems experienced with the prior art because it is small, light weight, and operable at low frequencies. In addition, the present invention allows for a wider range of bandwidths. These and other advantages and benefits of the present invention will become apparent from the description of the embodiments hereinbelow.

BRIEF DESCRIPTION OF THE SEVERAL VIEWS OF THE DRAWINGS

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements found in a typical filter. Those of ordinary skill in the art will recognize that other elements may be desirable. However, because such elements are well known in the art, and because they do not facilitate a better understanding of the present invention, a discussion of such elements is not provided herein.

Figure 1:
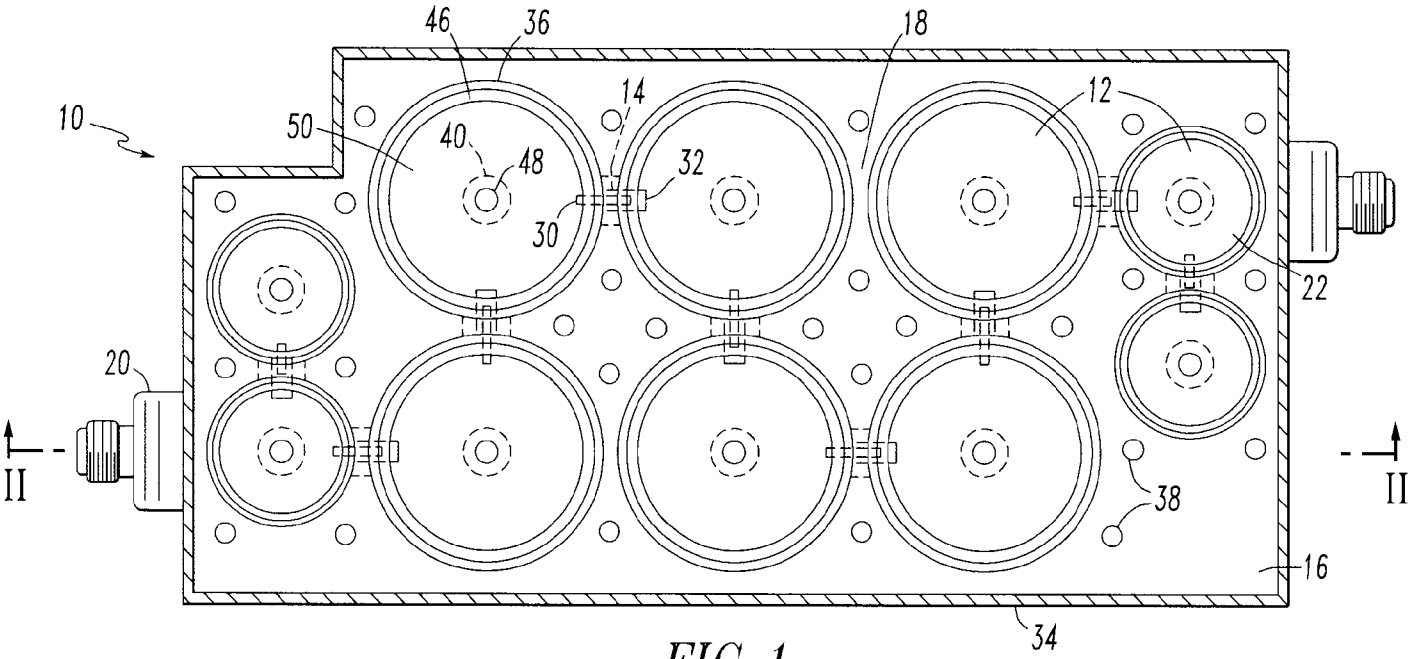
FIG. 1 is a top plan view of a filter according to the present invention without a cover.

FIG. 1 is a top plan view of a filter 10 constructed according to the present invention. The filter 10 is shown without a cover, although, as described hereinbelow, a cover (not shown) may be provided with the filter 10. A cover may also be omitted, such as when the filter 10 is placed on a printed circuit board and the printed circuit board acts as the cover. The filter 10 includes a number of stepped impedance resonators (SIRs) 12, a housing 16 with internal walls 18, and electrical connectors 20. The internal walls 18 define cavities within the housing 16. A filter 10 constructed according to the present invention may be operable below 2 GHz, such as 400 MHz, and may be used in applications such as, for example, satellite communications and base stations for cellular telephone service. The present invention will be described as a filter 10 including SIRs 12. The present invention, however, may be used with other types of resonators, such as uniform impedance resonators.

The SIRs 12 are located within the cavities defined by the internal walls 18 of the housing 16. The SIRs 12 may be constructed as described in Sagawa et al., *Geometrical Structures and Fundamental Characteristics of Microwave Stepped-Impedance Resonators*, IEEE Transactions on Microwave Theory and Techniques, v.45, No.7, July 1997, pp.1078–1085; and Makimoto et al., *Compact Bandpass Filters Using Stepped Impedance Resonators*, Proceedings of the IEEE, v.67, No.1, January 1979, pp.16–19. A stepped impedance resonator typically includes outer and inner conductors with dielectric material therebetween. The distance between the outer conductor and the inner conductor changes at a certain point along the length of the resonator, with that point being called the "step." The stepped configuration allows the length of a stepped impedance resonator to be significantly reduced in comparison to resonators having uniform dimensions, such as uniform impedance resonators.

FIG. 1 depicts a filter 10 with ten SIRs 12, although more or less SIRs 12 may be used to achieve different filter characteristics. For example, providing more SIRs 12 permits the realization of more precisely defined passbands, but also increases the insertion loss of the filter 10. The filter 10 may contain SIRs 12 of various size. For example, in some applications the input and output SIRs 12 of a filter 10 can be made significantly smaller than the rest of the SIRs 12 without severely affecting the performance of the filter 10. FIG. 1 illustrates the use of smaller "reject" SIRs 22, which improve the stopband performance of the filter 10, but which are not required to realize benefits of the present invention.

The housing 16 and internal walls 18 may be made integrally of plastic, such as a plastic with strength and thermal expansion characteristics comparable to aluminum. One example of such a material is a glass reinforced polyethermide resin, sold under the trade name ULTEM®, a registered trademark of General Electric Corporation, and available from General Electric Plastics Americas Division, Pittsfield, Mass. The housing 16 and internal walls 18 may be coated with a conductive film 34, such as silver. A process of forming the housing 16 and internal walls 18 is described more fully hereinbelow, as is a process of applying the coating 34. The housing 16 and internal walls 18 may also have openings 38 for receiving fasteners, such as may be used to hold a cover for the filter 10. The housing 16, including the internal walls 18, act as the outer conductor of a stepped impedance resonator structure and the SIRs 12 act as the inner conductor. A dielectric 36 may be included in the cavities defined by the internal walls 18 of the housing 16 (outer conductor) and the SIRs 12 (inner conductor). Preferably, the dielectric 36 has a loss tangent less than 0.05. Examples of suitable dielectrics with a loss tangent less than 0.05 include, for example, air, a fluoropolymer resin sold under the trade name Teflon®, a registered trademark of E.I. Du Pont De Nemours and Company, polystyrene, polyphenylene oxide, polyphenylene sulfide, and alumina. As described hereinbelow, with respect to FIGS. 8–9, a cover 60 may also be provided for the filter 10 to also act as an outer conductor.

The connectors 20 furnish a way to provide signals to and from the filter 10. The connectors 20 may be secured to the housing 16 and connected to the SIRs 12 in a variety of conventional ways, such as those described in the U.S. Pat. No. 5,329,687, issued to Scott et al., which is incorporated herein by reference.

Figure 2:
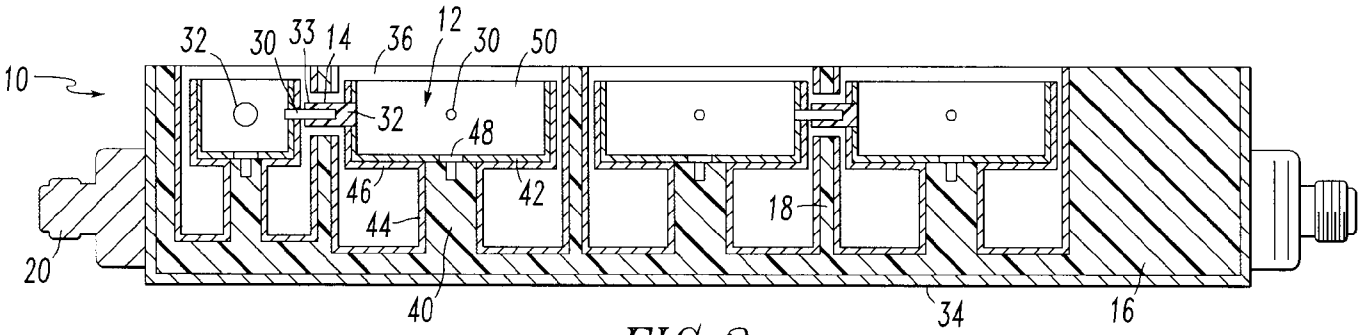
FIG. 2 is a cross-sectional view along line II—II of the filter of FIG. 1.

FIG. 2 depicts a cross-sectional view along line II—II of the filter 10 of FIG. 1. As can be seen more easily in FIG. 2, the filter 10 includes a number of coaxial cables 14 connecting the SIRs 12 together. The coaxial cables 14 may extend through the internal walls 18 of the housing 16 to connect the SIRs 12 together. Each cable 14 may have an inner conductor 30 connected to one SIR 12 and an outer conductor 32 connected to a different SIR 12. A dielectric 33, such as, for example, air or fluoropolymer resin, is between the inner conductor 30 and the outer conductor 32. As a result, the coaxial cables 14 capacitively couple the SIRs 12. The capacitance of the coaxial cables 14 is determined by their length. For example, when using a 50Ω coaxial cable, the proper length of the outer conductor 32 can determined by solving the equation:

$$l=cZ_o\upsilon \tag{1}$$

where c is the desired capacitance of the coaxial cable 14, $Z_o$=50Ω, and υ is the phase velocity. The phase velocity υ can be determined by solving the equation:

$$\upsilon=c/\sqrt{\epsilon_r} \tag{2}$$

where $\epsilon_r$ is the relative dielectric constant for the dielectric 33 of the coaxial cable 14, and where c is the speed of light(approximately $3\times10^8$ m/s) . The length l computed by equation (1) may not be exact, however, because of parasitic effects which are not easily modeled. If a particular application requires more precision than is possible from equation (1), a more precise length can be determined by experimentation. For example, the length provided by equation (1) can be made incrementally larger and smaller, and then tested to determine whether it yields the desired results. Several iterations may be required before reaching the optimum length. As illustrated in FIG. 2, a portion of the inner conductor 30 may extend beyond the outer conductor 32 and into the SIR 12 to which it is connected. At the relatively low operating frequencies typically used with the present invention, the extended portion of the inner conductor 30 will have a negligible effect on the performance of the filter 10. At higher frequencies, the length of the extended portion of the inner conductor 30 may be modified for better performance. In some filter designs it is advantageous for coupling capacitors to be of unequal value. Accordingly, the lengths of coaxial cables 14 may not always be uniform.

The SIRs 12 include a high impedance portion 40 and a low impedance portion 42. Together the high impedance portion 40 and the low impedance portion 42 act as the inner conductor of a stepped impedance resonator structure, as described hereinbefore. The SIRs 12 may be $\lambda_g/4$ type SIRs, i.e., quarter wavelength type SIRs, although other types may be used, such as $\lambda_g/2$ type and $\lambda_g$ type SIRs. The high impedance portions 40 may be formed integrally with the housing 16, that is, as a single piece. For example, the housing 16 and high impedance portion 40 may be formed from a single piece of plastic having strength and thermal expansion characteristics comparable to aluminum. Such thermal expansion characteristics permit the filter 10 to maintain its electrical characteristics over a large temperature range. One example of such a plastic is glass reinforced polyethermide resin, as described hereinbefore. The housing 16, internal walls 18, and high impedance portions 40 may be formed from a single piece of plastic, such as, for example, by conventional molding processes, such as injection and compression molding, or it may be formed, for example, by casting or machining. In one embodiment of the present invention, the housing 16, including the internal walls 18, has walls of relatively uniform thickness, such as within seventy percent, to minimize shrinking of the housing 16 during fabrication.

For an embodiment using glass reinforced polyethermide resin, there are typically two methods of applying the conductive film 34, 44. In the first method, the conductive film 34, 44 may include three layers deposited by vacuum metallization. A first layer of metal, such as aluminum, may be deposited to a thickness of approximately one $\mu$m on the surface of the housing 16, internal walls 18, and high impedance portions 40. An intermediate layer of, for example, copper or nickel, may be deposited to a thickness of approximately four $\mu$m. A final layer of metal, such as silver, may be approximately sixteen to twenty-four $\mu$m thick. In a second method, the surfaces of the housing 16, internal walls 18, and high impedance portions 40 may be prepared for plating by grit or bead blasting. A first metallic layer, such as electroless copper, may be deposited to a minimum thickness of one $\mu$m. Next, a final metallic layer, such as silver, may be deposited to a thickness of sixteen to twenty-four $\mu$m. Minor discontinuities or gaps in the conductive films 34, 44 may occur during the plating process, but will not substantially affect the performance of the filter 10.

Figure 3:
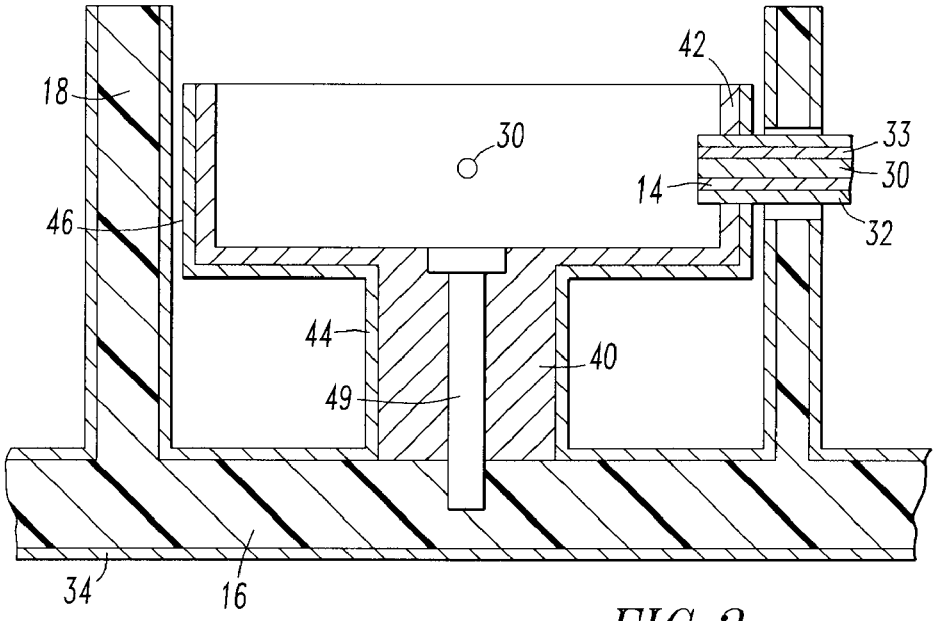
FIG. 3 is a more detailed cross-sectional view of a stepped impedance resonator of a filter according to another embodiment of the present invention.

The low impedance portion 42 of the SIR 12 may be formed from a metallic material, such as copper, copper alloys, or aluminum, and may be formed by deep drawing or by turning on a lathe. The low impedance portions 42 may also have a coating of conductive film 46, such as silver. The high impedance portions 40 and the low impedance portions 42 may be fastened together, for example, by axially aligned hold down screws 48. In another embodiment of the present invention, illustrated in FIG. 3, the low impedance portions 42 may be integrally formed with the high impedance portions 40, such as from glass reinforced polyethermide resin, and may be coated with a conductive film 46, such as silver, as described hereinbefore. The low impedance portions 42 and the high impedance portions 40 may be fastened to the housing 16, such as by axially aligned hold down screws 49.

In one embodiment of the invention, the vertical length of the SIRs 12 are equal, although another embodiment contemplates SIRs 12 of various lengths. Varying the vertical length of the SIRs 12 affects their resonance frequency, as described hereinbelow. Also, in one embodiment of the invention, the shape of the high impedance portions 40 and low impedance portions 42 are generally cylindrical, as illustrated in FIG. 1, although other geometrical shapes may be used, which may affect the resonance frequency of the SIR 12 and the capacitive coupling between SIRs 12. If the low impedance portions 42 are generally cylindrical, the low impedance portions 42 may generally define annular cavities. The annular cavities defined by the low impedance portions 42 may be filled with dielectric 50. In one embodiment of the invention, the dielectric 50 is air. Other embodiments of the invention contemplate the use of other dielectrics 50.

Figure 4:
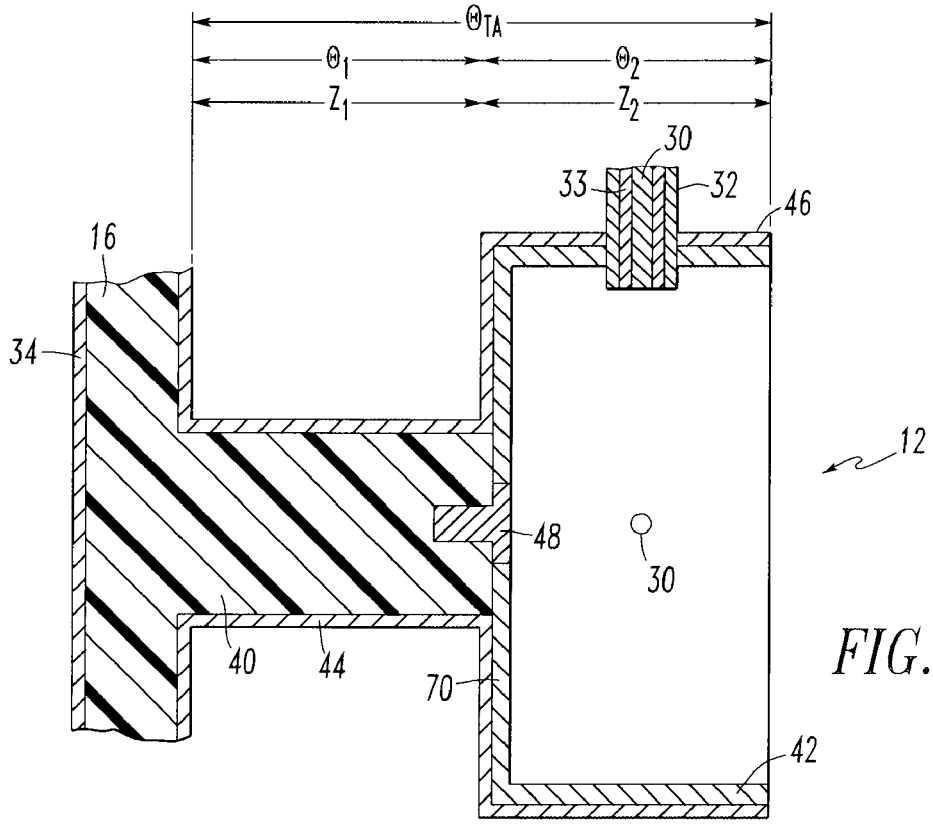
FIG. 4 is a more detailed cross-sectional view of a stepped impedance resonator according to the filter of FIGS. 1 and 2.

FIG. 4 is a more detailed cross-sectional view of a $\lambda_g/4$ type SIR 12 according to the present invention. The inner conductor includes a high impedance portion 40, a low impedance portion 42, and a stepped portion 70. The high impedance portion 40 and the low impedance portion 42 have a coating of conductive film 44, 46 as described hereinbefore.

In designing a filter 10 according to the present invention, the resonance frequency of a SIR 12 is a function of the resonator length and the impedance ratio of the high impedance portion 40 and the low impedance portion 42 of the SIR 12. For a $\lambda_g/4$ type SIR, the total electrical length of a SIR 12, denoted by $\Theta_{TA}$, can be represented as:

$$\Theta_{TA}=\Theta_1+\Theta_2 \tag{3}$$

where $\Theta_1$ is the electrical length of the high impedance portion 40, and $\Theta_2$ is the electrical length of the low impedance portion 42. The impedance ratio, denoted by $R_Z$, between the two portions can be represented by:

$$R_Z=\tan\Theta_1\cdot\tan\Theta_2=Z_2/Z_1 \tag{4}$$

where $Z_2$ is the impedance of the low impedance portion 42 and $Z_1$ is the impedance of the high impedance portion 40. Inserting equation (4) into equation (3) yields:

$$\Theta_{TA}=\Theta_1+\tan^{-1}(R_Z/\tan\Theta_1) \tag{5}$$

Thus, the electrical length of the SIR 12, $\Theta_{TA}$, approaches a minimum when $R_Z$ approaches a minimum, which corresponds to:

$$\Theta_1=\Theta_2\tan^{-1}\sqrt{R_Z} \tag{6}$$

Experiments have shown, however, that $\Theta_{TA}$ is actually less than that computed according to equation (5). This discrepancy is caused by parasitic capacitance at the stepped portion 70 of the SIR 12 which is ignored in equation (5) because it is difficult to model. Given this condition, the relationship between the fundamental resonance frequency, denoted as $f_0$, and the lowest spurious frequency of a $\lambda_g/4$ type SIR, denoted as $f_{SA}$, assuming transverse electromagentic (TEM) mode, is given by:

$$f_{SA}/f_0=(\pi/\tan^{-1}\sqrt{R_Z})-1 \tag{6}$$

The cross-sectional shape of the respective low impedance portions 42 and high impedance portions 40 of the SIRs 12 is determined by design parameters, such as filter size and bandwidth. The size of the cavities defined by the internal walls 18 of the housing 16 determines the quality factor (Q) of the resonator. The larger the cavities, the greater the Q factor. If the cavities are too large, however, it no longer behaves as a TEM mode cavity. Instead, higher order modes, such as transverse electric (TE) and transverse magnetic (TM), may be excited. The higher order modes are capable of transmitting or absorbing a significant portion of the signal. The lowest order waveguide mode is excited to the exclusion of other modes when the circumference of the cavities defined by the housing 16 approaches one-half wavelength.

For an embodiment of the present invention in which the impedance portion 40 is constructed of plastic and fastened to the low impedance portion 42, the minimum size of a cylindrically shaped high impedance portion 40 is limited by the fastener, such as the hold down screw 48, which fastens the high impedance portion 40 to the low impedance portion 42. For example, if the diameter of high impedance portion 40 is too small, the high impedance portion 40 may split upon insertion of the screw 48.

The size of the low impedance portions 42 is limited by the size of the cavities defined by the internal walls 18 of the housing 16. An increase in the size of the low impedance portions 42 concomitantly reduces the space between the low impedance portions 42 and the internal walls 18 of the housing 16. Although it is critical to keep the distance between the low impedance portion 42 and the internal walls 18 small, if this "gap" is too small, and the filter 10 is to handle high power, the dielectric 36 in the cavity may breakdown.

Figure 5:
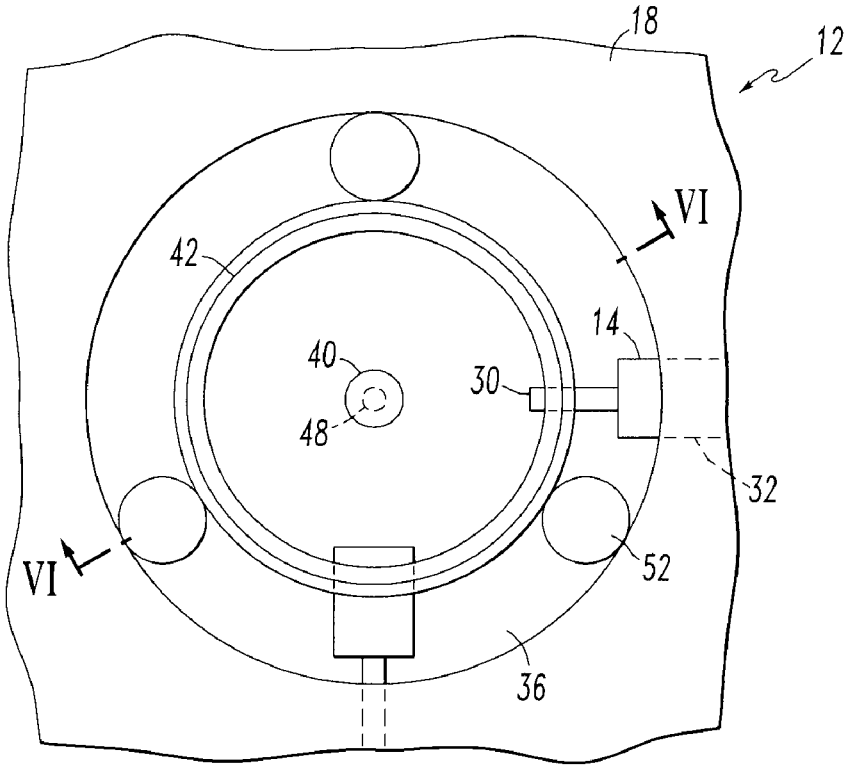
FIG. 5 is a top plan view of a stepped impedance resonator of a filter according to another embodiment of the present invention.
Figure 6:
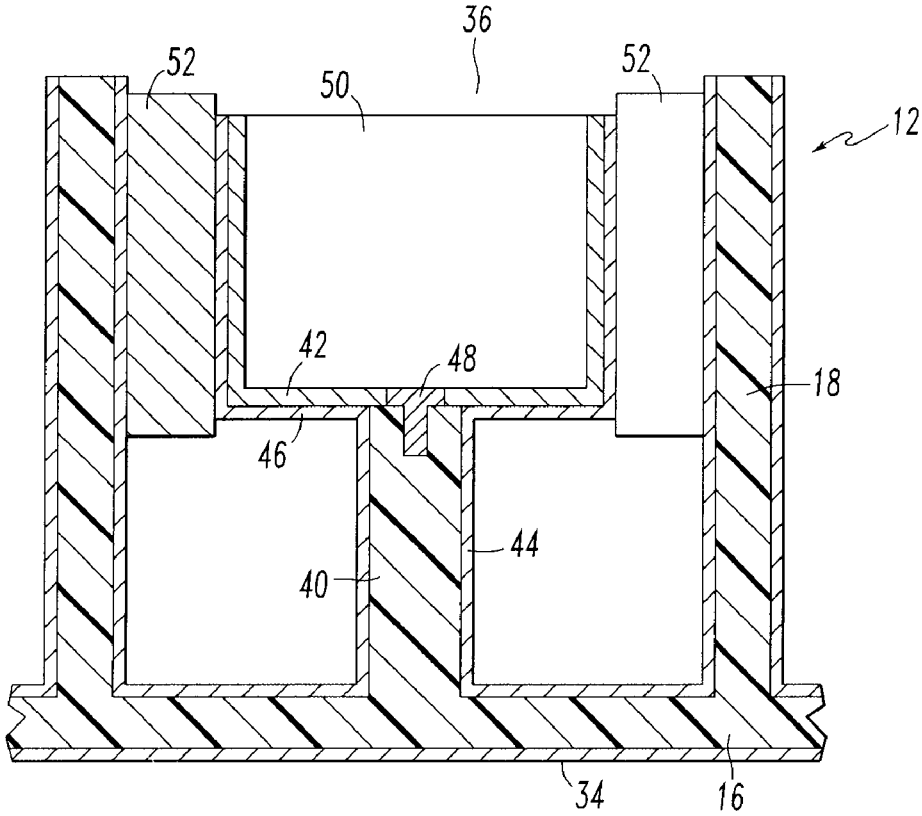
FIG. 6 is a cross-sectional view along line VI—VI of the stepped impedance resonator of FIG. 5.
Figure 7:
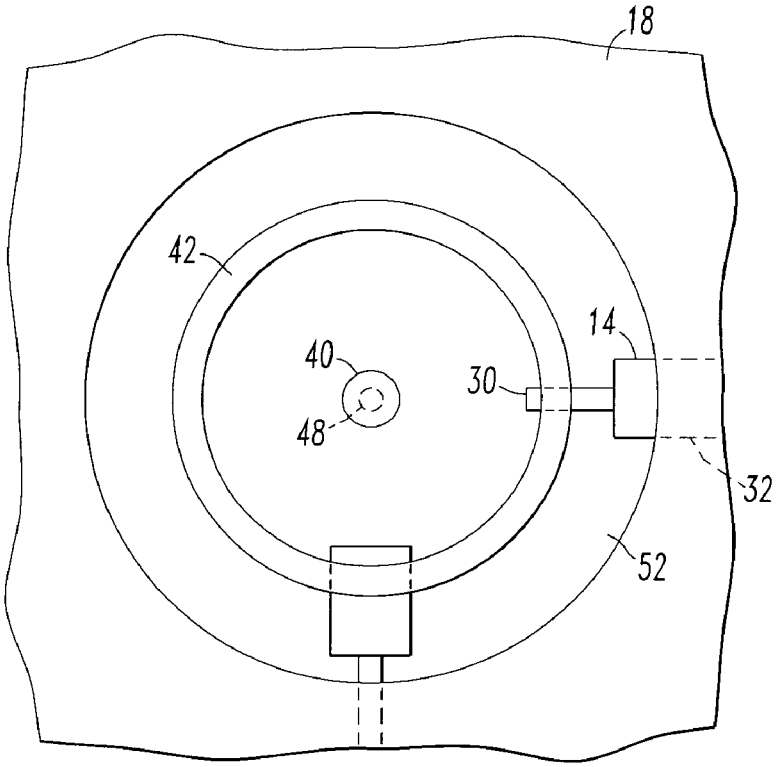
FIG. 7 is a top plan view of a stepped impedance resonator of a filter according to another embodiment of the present invention.

FIGS. 5–7 illustrate another embodiment of the present invention. FIG. 5 is a top plan view of an SIR 12 and FIG. 6 is a cross-sectional view along line VI—VI of the SIR 12 of FIG. 5. In this embodiment, to ensure that the low impedance portion 42 is centered in the cavity defined by the internal walls 18, a spacer 52 may be placed between the internal walls 18 and the low impedance portion 42. The spacer 52 may be, for example, a rod running longitudinally along the length of the low impedance portion 42. The spacer 52 may be made of dielectric material, such as, for example, fluoropolymer resin or polystyrene. A number of spacers 52 may be used for each low impedance portion 42, and may be evenly spaced. In the embodiment illustrated in FIG. 5, three spacers 52 are utilized. In addition to ensuring that the low impedance portion 42 is centered within the cavity, the spacers 52 help to dampen acoustic "ringing" of the low impedance portion 42. Another advantage of using spacers 52 is to minimize sensitivity of the filter 10 to temperature changes associated with dielectric loading of the low impedance portion 42. In another embodiment, to ensure centering of the low impedance portion 42 within the cavity, the spacer 52 may be a dielectric ring inserted between the low impedance portion 42 and the internal walls 18, as illustrated in FIG. 7.

Figure 8:
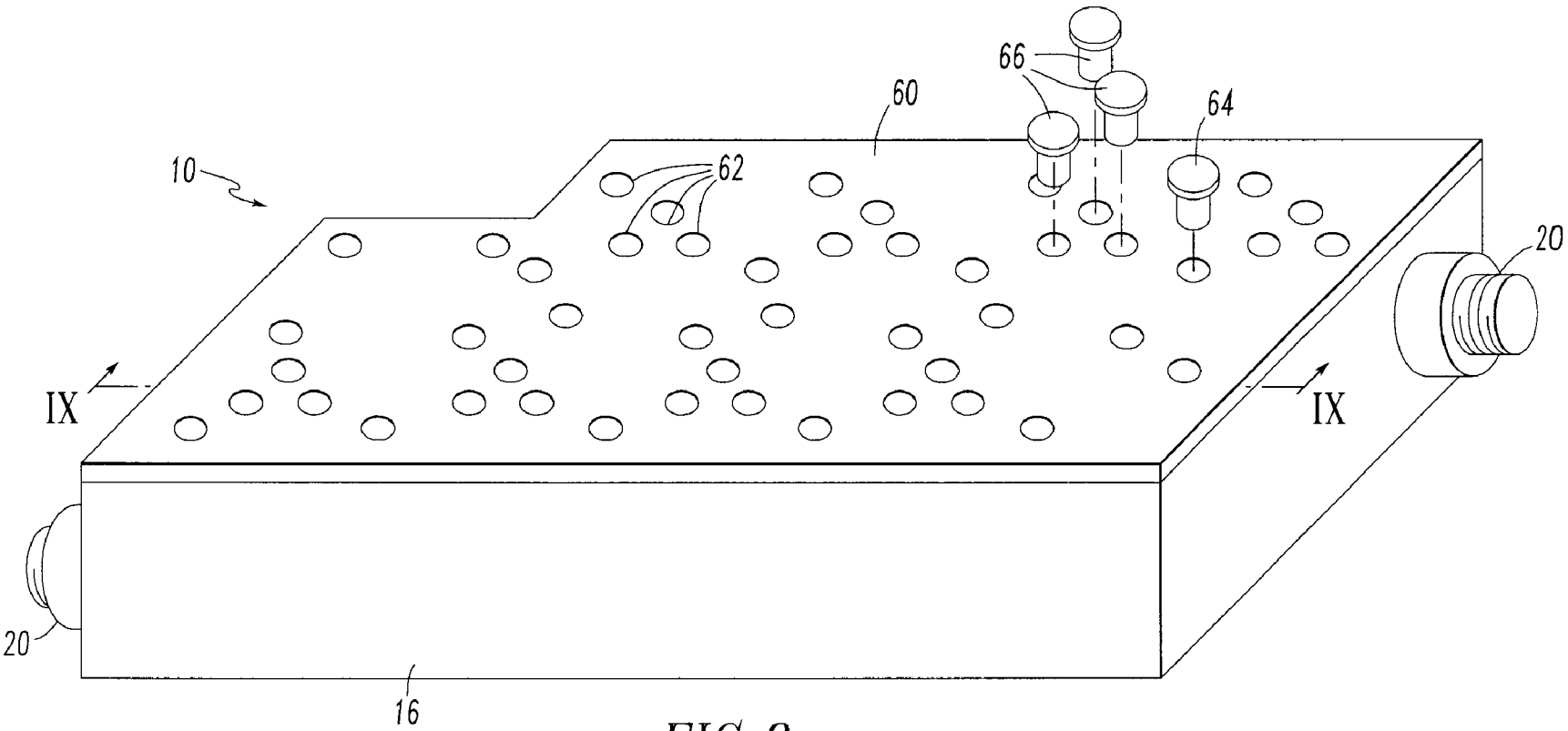
FIG. 8 is a perspective of the filter of FIG. 1 with a cover.
Figure 9:
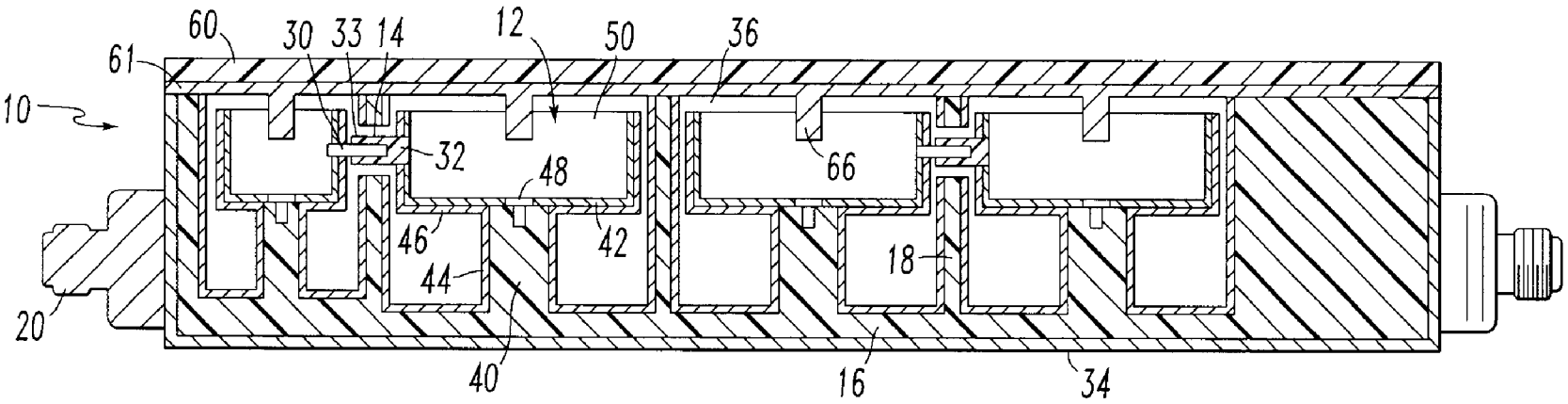
FIG. 9 is a cross-sectional view along line IX—IX of the filter of FIG. 8.

FIGS. 8 and 9 depict a filter 10 with a cover 60. The cover 60 may include a number of openings 62 that may be used in conjunction with fasteners 64, such as hold down screws, to secure the cover 60 to the housing 16 and internal walls 18. The openings 62 may also be used in conjunction with tuning devices 66 to tune the SIRs 12. In another embodiment, a snap-fit assembly of the cover 60 and housing 16 may be used, as described in the Scott et al. patent. In another embodiment, the housing 16 and cover 60 may be bonded together. Suitable commercially available bonding adhesives include silver filled epoxies or conductive RTVs. Further, as described hereinbefore, the cover 60 acts as part of the outer conductor for the SIRs 12.

In one embodiment of the invention, the cover 60 is molded, such as from plastic, and then coated with a conductive film 61, such as silver, in a manner similar to the housing 16 and high impedance portions 40, as described hereinbefore. Only the surface of the cover 60 facing the cavity and the openings 62 needs to be coated, although the other surfaces of the cover 60 may be coated. In another embodiment of the invention, the cover is formed from a conductive material, such as aluminum.

Some of the openings 62 in the cover 60 may be aligned with the dielectric 50 in the annular cavities defined by the low impedance portions 42 of the SIRs 12 for use by the tuning devices 66. The number of openings 62 aligned with the dielectric 50 in each annular cavity may vary. The illustrated embodiment uses three openings 62 per annular cavity, although more or less openings 62 may be used.

Tuning devices 66 may be inserted through the openings 62 so as to be disposed in the dielectric 50 in the annular cavities defined by the low impedance portions 42, and positioned in operable relation with the low impedance portions 42. The tuning devices 66 are electrically conductive, and may be, for example, metal screws. In one embodiment of the invention, three tuning devices 66 are disposed in the annular cavity. The tuning devices 66 do not contact the low impedance portions 42 of the SIRs 12, thereby providing capacitive coupling between the tuning devices 66 and the SIR 12. The position of the tuning devices 66 relative to the SIR 12 determines the frequency of the resonator as provided by the SIR 12.

Figure 10:
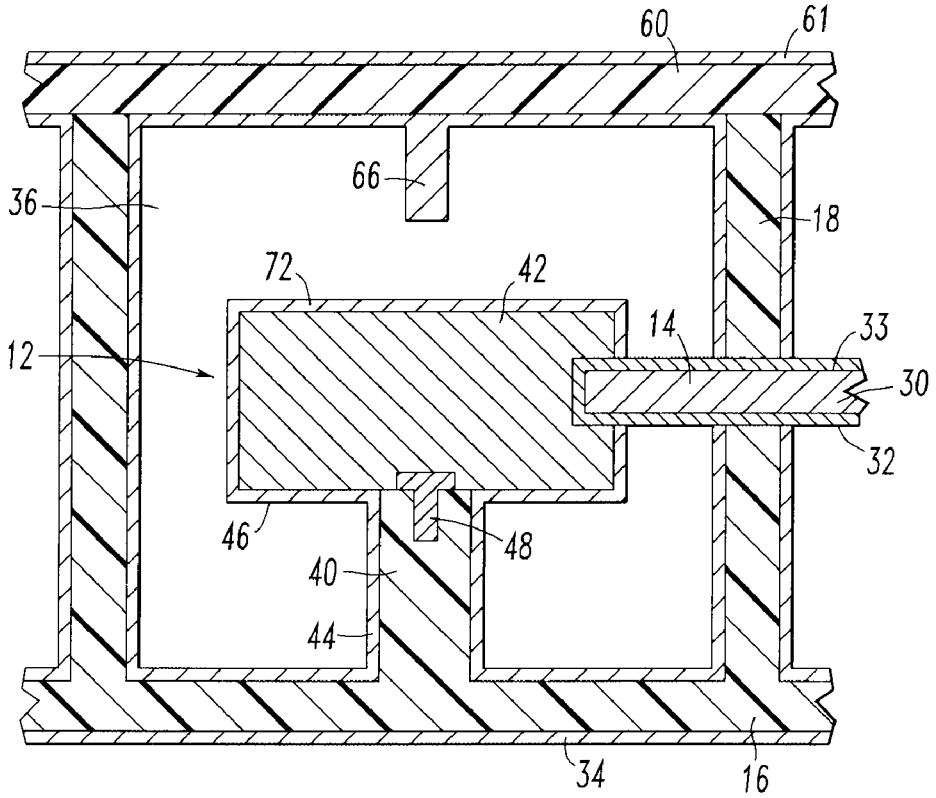
FIG. 10 is a partial cross-sectional side-view of a stepped impedance resonator of a filter according to another embodiment of the present invention.

FIG. 10 is a partial cross-sectional side-view of another embodiment of an SIR 12 of a filter 10 according to the present invention. In that embodiment, the low impedance portion 42 does not define an annular cavity. Rather it is close-ended with a top portion 72. The tuning device 66 is inserted through the openings 62 of the cover 60, and extends in operable relation to the top portion 72 of the low impedance portion 42.

Figure 11:
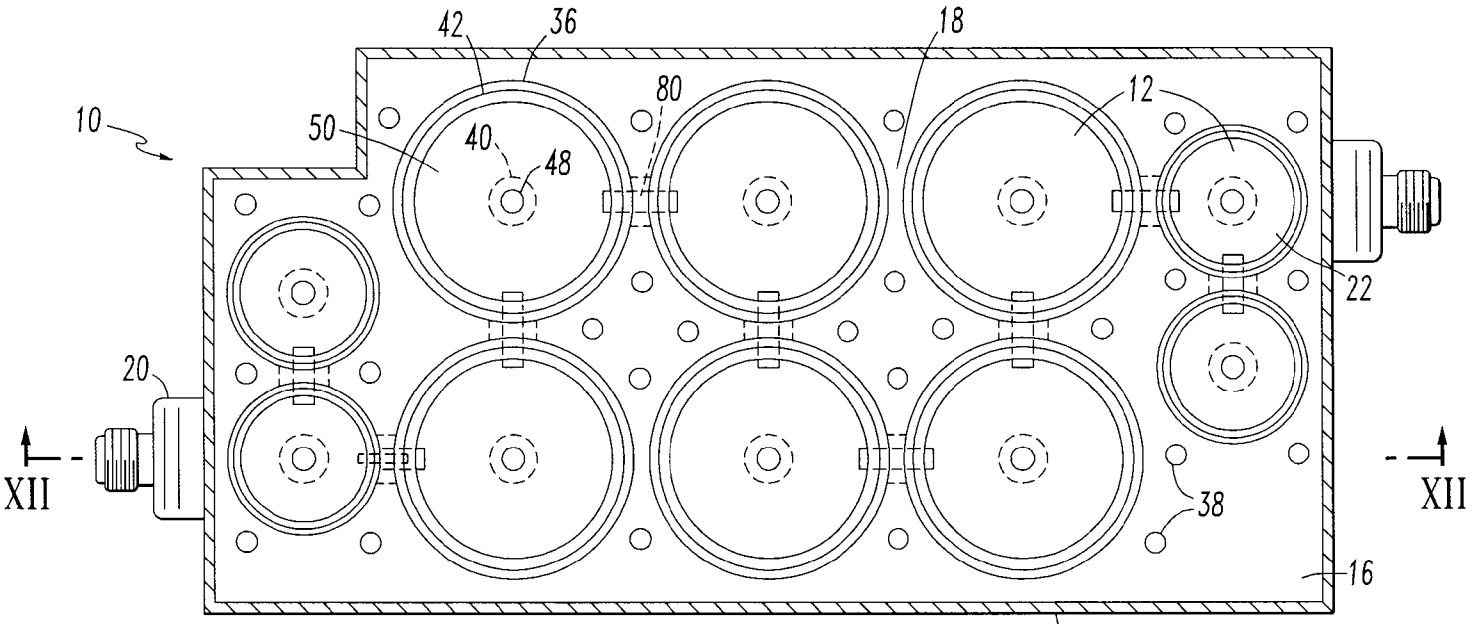
FIG. 11 is a top plan view of a filter according to another embodiment of the present invention.
Figure 12:
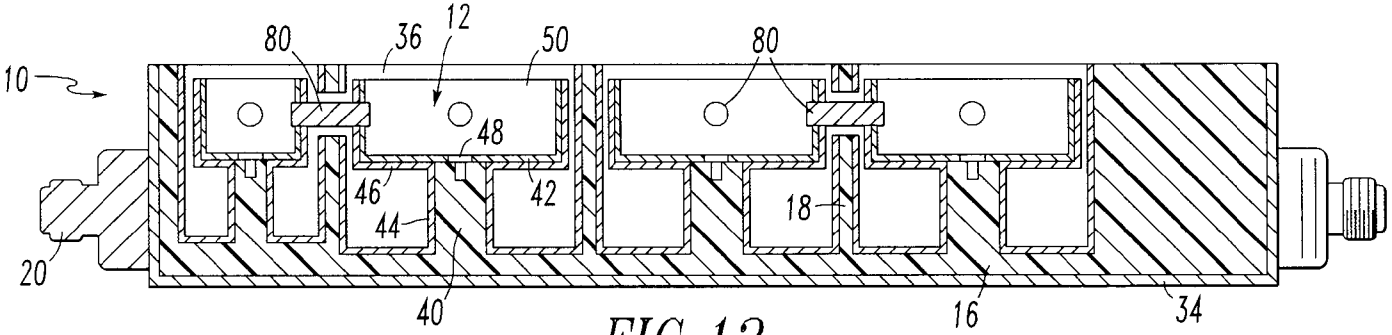
FIG. 12 is a cross-sectional view along line XII—XII of the filter of FIG. 11.

FIGS. 11 and 12 illustrate another embodiment of the present invention. FIG. 11 is a top plan view of a filter 10 without a cover and FIG. 12 is a cross-sectional view along line XII—XII of the filter 10 of FIG. 11. In this embodiment, the SIRs 12 are capacitively coupled by connecting trimmer capacitors 80 between the SIRs 12. Trimmer capacitors 80 provide an advantage over coupling the SIRs 12 with coaxial cables 14 in that trimmer capacitors 80 are tunable over a range of capacitance. Trimmer capacitors 80 usually, however, have greater electric loss than coaxial cables 14, thus lessening the Q factor of the filter 10.

The present invention is also directed to a method of manufacturing a filter 10 according to the present invention. The method includes integrally forming from a single piece of material, such as plastic, a housing 16 and a high impedance portion 40 of an SIR 12, and fastening a low impedance portion 42 of the SIR 12 to the high impedance portion 40, such as with a screw 48. The housing 16 and high impedance portion 40 may be formed, for example, by molding processes, such as injection or compression molding, or they may be formed, for example, by casting or machining. The method may further include coating the housing 16 and high impedance portion 40 with a conductive film 34, such as silver.

The present invention is also directed to a method of coupling resonators of a filter 10. The method includes providing a coaxial cable 14 between two resonators of the filter 10. The resonators may, for example, be stepped impedance resonators. The coaxial cable 14 may have an inner conductor 30 connected to one resonator and an outer conductor 32 connected to the other resonator. A dielectric material, such as, for example, air or fluoropolymer resin, is between the inner conductor 30 and the outer conductor 32 of the coaxial cable 14. In an alternative embodiment, as illustrated in FIGS. 11 and 12, stepped impedance resonators 12 may be capacitively coupled by connecting a trimmer capacitor 80 between two of the SIRs 12 of the filter 10.

Those of ordinary skill in the art will recognize that many modifications and variations of the present invention may be implemented. The foregoing description and the following claims are intended to cover all such modifications and variations. Furthermore, the materials and processes disclosed are illustrative, but are not exhaustive. Other materials and processes may also be used to make devices embodying the present invention.

What is claimed is:

1. A filter comprising:

first and second resonators, wherein said resonators are stepped impedance resonators including a high impedance portion connected to a low impedance portion, wherein said high impedance portions are integral with a housing, and wherein said high impedance portions are plastic and include a coating of conductive film; and a coaxial cable including an inner conductor connected to said first resonator and an outer conductor connected to said second resonator.

2. The filter of claim 1, wherein said high impedance portions are integral with said low impedance portions.

3. The filter of claim 1, further comprising a dielectric material between said inner conductor and said outer conductor of said coaxial cable.

4. The filter of claim 3, wherein said dielectric material is selected from the group consisting of air and fluoropolymer resin.

5. A filter, comprising:

a housing defining at least one cavity;

a plurality of stepped impedance resonators, each said stepped impedance resonator including a high impedance portion integral with said housing, and a low impedance portion connected to said high impedance portion, wherein one of said stepped impedance resonators is disposed in said cavity;

at least one coaxial cable capacitively coupling two of said plurality of stepped impedance resonators, wherein said coaxial cable has an inner conductor connected to a first stepped impedance resonator and an outer conductor connected to a second stepped impedance resonator; and at least one spacer of dielectric material in said cavity between said housing and said stepped impedance resonator disposed in said cavity.

6. The filter of claim 5, wherein:

said high impedance portion and said housing are plastic and include a coating of conductive film.

7. The filter of claim 5, further comprising a cover connected to said housing.

8. The filter of claim 5, wherein said cavity contains dielectric material with a loss tangent less than 0.05.

9. The filter of claim 8, wherein said dielectric material is selected from the group consisting of air, polystyrene, polyphenylene oxide, polyphenylene sulfide, fluoropolymer resin, and alumina.

10. The filter of claim 5, wherein said spacer is a fluoropolymer resin.

11. The filter of claim 5, wherein said spacer is polystyrene.

12. The filter of claim 5, wherein said spacer is a rod.

13. The filter of claim 5, wherein said spacer is a ring.

14. The filter of claim 5, wherein said low impedance portion is a metal selected from the group consisting of copper, alloyed copper, and aluminum.

15. A filter, comprising:

a housing;

first and second stepped impedance resonators, each said stepped impedance resonator including a high impedance portion integral with said housing, and a low impedance portion connected to said high impedance portion, wherein said low impedance portion includes an inner surface and an outer surface, wherein said inner surface of said low impedance portion defines a cavity, and wherein said high impedance portion is connected to said outer surface of said low impedance portion; and a coaxial cable including an inner conductor connected to said low impedance portion of said first stepped impedance resonator and an outer conductor connected to said low impedance portion of said second stepped impedance resonator.

16. A filter, comprising:

a housing; and a plurality of stepped impedance resonators, each said stepped impedance resonator including a high impedance portion integral with said housing, and a low impedance portion connected to said high impedance portion, wherein said high impedance portion and said housing are plastic and include a conductive film.

17. The filter of claim 16, further comprising at least one trimmer capacitor connected between two of said plurality of stepped impedance resonators.

18. The filter of claim 16, further comprising at least one coaxial cable connected between two of said plurality of stepped impedance resonators.

19. The filter of claim 16, further comprising a cover connected to said housing.

20. A filter, comprising:

a housing defining a cavity;

a plurality of stepped impedance resonators, each said stepped impedance resonator including a high impedance portion integral with said housing, and a low impedance portion connected to said high impedance portion, wherein one of said stepped impedance resonators is disposed in said cavity;

a cover connected to said housing; and at least one dielectric spacer in said cavity between said housing and said stepped impedance resonator disposed in said cavity.

21. The filter of claim 20, further comprising at least one trimmer capacitor connected between two of said plurality of stepped impedance resonators.

22. The filter of claim 20, further comprising at least one coaxial cable connected between two of said plurality of stepped impedance resonators.

23. A filter, comprising:

a housing defining at least one cavity;

a plurality of stepped impedance resonators, each said stepped impedance resonator including a high impedance portion integral with said housing, and a low impedance portion connected to said high impedance portion, wherein a first of said plurality of stepped impedance resonators is disposed in said cavity; and at least one dielectric spacer disposed in said cavity between said housing and said first stepped impedance resonator.

24. The filter of claim 23, further comprising at least one trimmer capacitor connected between two of said plurality of stepped impedance resonators.

25. The filter of claim 23, further comprising at least one coaxial cable connected between two of said plurality of stepped impedance resonators.

26. The filter of claim 23, further comprising a dielectric material having a loss tangent less than 0.05 disposed in said cavity.

27. A method of manufacturing a filter, comprising:

forming a housing and a high impedance portion of a stepped impedance resonator as an integral piece;

fastening a low impedance portion of said resonator to said high impedance portion; and coating the housing and the high impedance portion with a conductive film.

28. The method of claim 27, wherein forming a housing and a high impedance portion is selected from the group consisting of molding, casting and machining.

29. The method of claim 27, wherein forming includes forming a housing and a high impedance portion of a stepped impedance resonator from plastic.

30. The method of claim 27, wherein coating includes coating the housing and the high impedance portion with silver.

31. A method of manufacturing a filter, comprising:

forming from plastic a housing and a plurality of high impedance portions of stepped impedance resonators as an integral piece;

fastening a plurality low impedance portions of said stepped impedance resonators to said plurality of high impedance portions; and capacitively coupling said stepped impendance resonators.

32. The method of claim 31, further comprising coating said housing and said high impedance portions with a conductive film.

33. The method of claim 31, wherein capacitively coupling said stepped impedance resonators includes connecting a trimmer capacitor between a first stepped impedance resonator and a second stepped impedance resonator.

34. The method of claim 31, wherein capacitively coupling said stepped impedance resonators includes connecting a coaxial cable between a first stepped impedance resonator and a second stepped impedance resonator.

35. The method of claim 34, wherein said coaxial cable has an inner conductor connected to said first stepped impedance resonator and an outer conductor connected to said second stepped impedance resonator.

36. A dielectric loaded filter, comprising:

a housing;

first and second stepped impedance resonators, wherein each of said stepped impedance resonators includes a high impedance portion connected to a low impedance portion, and wherein each of said high impedance portions is integral with said housing;

a first dielectric having a loss tangent less than 0.05 disposed between said first stepped impedance resonator and said housing; and a second dielectric having a loss tangent less than 0.05 disposed between said second stepped impedance resonator and said housing.

37. The filter of claim 36, further comprising a coaxial cable connected between said first and second stepped impedance resonators.

38. The filter of claim 37, wherein the inner conductor of said coaxial cable is connected to said low impedance portion of the said first stepped impedance resonator, and wherein said outer conductor of said coaxial cable is connected to said low impedance portion of said second stepped impedance resonator.

39. The filter of claim 36, further comprising a trimmer capacitor connected between said first and second stepped impedance resonators.

40. The filter of claim 39, wherein said trimmer capacitor is connected between said low impedance portion of said first stepped impedance resonator and said low impedance portion of said second stepped impedance resonator.

41. The filter of claim 36, wherein the first dielectric is selected from the group consisting of polystyrene, polyphenylene oxide, polyphenylene sulfide, fluoropolymer resin, and alumina.

42. A filter, comprising:

a housing;

a plurality of stepped impedance resonators, each said stepped impedance resonator including a high impedance portion integral with said housing, and a low impedance portion connected to said high impedance portion, wherein said high impedance portion and said housing are plastic and include a coating of conductive film; and at least one coaxial cable capacitively coupling two of said plurality of stepped impedance resonators, wherein said coaxial cable has an inner conductor connected to a first stepped impedance resonator and an outer conductor connected to a second stepped impedance resonator.

43. A method of manufacturing a filter, comprising:

forming from plastic a housing and a high impedance portion of a stepped impedance resonator as an integral piece;

fastening a low impedance portion of said resonator to said high impedance portion.

44. A filter, comprising:

first and second stepped impedance resonators, each said stepped impedance resonator including a low impedance portion connected to a high impedance portion, wherein said low impedance portion includes an inner surface and an outer surface, wherein said inner surface of said low impedance portion defines a cavity, and wherein said high impedance portion is connected to said outer surface of said low impedance portion; and a coaxial cable including an inner conductor connected to said low impedance portion of said first stepped impedance resonator and an outer conductor connected to said low impedance portion of said second stepped impedance resonator.

45. The filter of claim 44, further comprising a housing, wherein said housing is integral with said high impedance portions of said first and second stepped impedance resonators.

46. The filter of claim 45, wherein said housing and said high impedance portions of said first and second stepped impedance resonators include plastic with an electrically conductive coating.

47. The filter of claim 44, further comprising:

a housing defining a cavity, wherein said first stepped impedance resonator is disposed in said housing; and a dielectric spacer disposed in said cavity between said housing and said first stepped impedance resonator.

48. The filter of claim 47, wherein said housing defines a second cavity, and wherein said second stepped impedance resonator is disposed in said second cavity, and further comprising a second dielectric spacer disposed in said second cavity between said housing and said second stepped impedance resonator.

49. A filter, comprising:

first and second stepped impedance resonators, each said stepped impedance resonator including a low impedance portion connected to a high impedance portion, wherein said low impedance portion includes an inner surface and an outer surface, wherein said inner surface of said low impedance portion defines a cavity, and wherein said high impedance portion is connected to said outer surface of said low impedance portion; and a trimmer capacitor connected between said first and second stepped impedance resonators.

50. The filter of claim 49, further comprising a housing, wherein said housing is integral with said high impedance portions of said first and second stepped impedance resonators.

51. The filter of claim 50, wherein said housing and said high impedance portions of said first and second stepped impedance resonators include plastic with an electrically conductive coating.

52. The filter of claim 49, further comprising:

a housing defining a cavity, wherein said first stepped impedance resonator is disposed in said housing; and a dielectric spacer disposed in said cavity between said housing and said first stepped impedance resonator.

53. The filter of claim 52, wherein said housing defines a second cavity, and wherein said second stepped impedance resonator is disposed in said second cavity, and further comprising a second dielectric spacer disposed in said second cavity between said housing and said second stepped impedance resonator.

* * * * *